United States Patent [19]

Koenig

[11] 4,006,772

[45] * Feb. 8, 1977

[54] METHOD AND APPARATUS FOR CASTING STEEL INTO A CONTINUOUS CASTING MOLD

[75] Inventor: Peter J. Koenig, Zumikon, Switzerland

[73] Assignee: Concast AG, Zurich, Switzerland

[ * ] Notice: The portion of the term of this patent subsequent to Aug. 12, 1992, has been disclaimed.

[22] Filed: June 17, 1974

[21] Appl. No.: 480,060

[30] Foreign Application Priority Data

June 22, 1973 Switzerland ..... 9161/73

[52] U.S. Cl. ..... 164/66; 164/281 R

[51] Int. Cl.[2] ..... B22D 11/10

[58] Field of Search ..... 164/66, 281

[56] References Cited

UNITED STATES PATENTS

| | | | |
|---|---|---|---|
| 2,938,251 | 5/1960 | Baier | 164/281 X |
| 3,208,117 | 9/1965 | Goedecke et al. | 164/56 |
| 3,459,346 | 8/1969 | Tinnes | 222/566 |
| 3,502,249 | 3/1970 | Wagstaff | 222/544 |
| 3,517,726 | 6/1970 | Mills et al. | 164/281 X |
| 3,608,621 | 9/1971 | Bollig et al. | 164/281 |
| 3,886,992 | 6/1975 | Maas et al. | 164/66 X |
| 3,899,018 | 8/1975 | Koenig | 164/281 X |

FOREIGN PATENTS OR APPLICATIONS

| | | | |
|---|---|---|---|
| 662,295 | 8/1935 | Germany | 164/66 |

*Primary Examiner*—John E. Roethel
*Attorney, Agent, or Firm*—Werner W. Kleeman

[57] ABSTRACT

A method of and apparatus for casting steel into a continuous casting mold, wherein the steel is introduced into the casting head to a point beneath the liquid metal pool and the steel, prior to its departure out of a pouring tube, is treated with an inert gas while forming small gas bubbles. The resultant steel-gas mixture during its outflow into the metal pool in the form of a thin, coherent fan or pattern is simultaneously introduced downwardly as well as also laterally. The pouring tube possesses an outlet opening in the form of a downwardly and laterally extending slot and a gas infeed means above such outlet opening.

12 Claims, 5 Drawing Figures

METHOD AND APPARATUS FOR CASTING STEEL INTO A CONTINUOUS CASTING MOLD

BACKGROUND OF THE INVENTION

The present invention relates to a new and improved method of casting or pouring steel into a continuous casting mold wherein the steel is introduced by means of a pouring tube into the casting head i.e. the liquid metal pool to a location beneath the level of such liquid metal pool in the mold and the steel prior to its departure out of the pouring tube is treated with an inert gas while forming small bubbles, and furthermore, this invention also relates to a new and improved construction of apparatus for the performance of the aforesaid method.

In order to improve upon separation of nonmetallic inclusions during continuous casting operations it is known to the art to arrange beneath an outflow nozzle of a tundish a chamber-like device into which the casting jet flows in a freefall. This chamber possesses lateral openings through which the casting jet flows into the liquid metal pool after experiencing a change in flow direction which is brought about by the floor of the chamber. By destroying a part of the kinetic energy and the resultant reduction in the flow velocity it is intended to provide an easier separation of the contaminants. By infeeding oxidizing or inert gases into the intermediate space between the casting jet and the chamber walls it is further intended to influence the composition of the inclusions. However, this prior art technique neither is intended to nor does it influence the formation of the flow at the casting head by means of the gas which likewise flows through the chamber. There also does not occur any appreciable admixing with the gas. Additionally, such prior art apparatus is associated with the drawback that it is relatively expensive and difficult to use.

Furthermore, it is known to the art to treat the casting jet with the gas bubbles and to introduce such beneath the level of the molten metal bath of the mold by means of an immersed pouring tube having oval or circular outlet openings. Thus, the gas is delivered to the steel at the location of the formation of the casting jet, for instance above the stopper. Although according to this proposal there is realized a qualitative improvement of the cast product, still it has not been possible to influence the flow conditions at the casting head in such a way that there is realized an optimum possibility of separating out the inclusions.

SUMMARY OF THE INVENTION

Hence, it is a primary object of the present invention to provide an improved method of, and apparatus for, casting steel into a continuous casting mold in a manner not associated with the aforementioned drawbacks and limitations of the prior art proposals.

Another and more specific object of the present invention aims at improving the flow conditions in the casting head i.e. liquid metal pool in the mold and realizing improved separation conditions for non-metallic inclusions, so that the quality of the cast product as well as the fabricated products produced therefrom, such as for instance heavy plate, are improved.

It is a further object of the present invention to provide only a relatively slight penetration depth of the casting jet into the liquid metal pool as well as realizing as uniform as possible solidification conditions for the cast strand and an undisturbed growth of the shell or skin thereof.

Now in order to implement these and still further objects of the invention, which will become more readily apparent as the description proceeds, the invention contemplates that the steel-gas mixture during its outflow in the form of a thin, coherent pattern is simultaneously introduced downwardly as well as also laterally into the liquid metal pool.

When using the teachings of the invention the fan-shaped or thin coherent pattern of the steel-gas mixture which is delivered into the liquid metal pool possesses a surprisingly low penetration depth. The steel-gas mixture which departs from the slot-shaped opening of the pouring tube produces a stable turbulence at a region of the liquid metal pool which is sharply limited towards the bottom. Additionally there are present extremely favorable separation conditions for non-metallic inclusions, since a limited turbulence zone is formed at the region of the casting head and owing to the thereby improved flotation conditions floating entrainment of contaminants into the depth of the mold is suppressed, which otherwise would predominantly occur along the narrow sides of the mold. Furthermore, it has been found that due to the admixing of the gas there is also present the phenomenon that a considerable proportion of the volume of the steel escapes towards the sides so that there is promoted the formation of a uniform shell without the danger of washouts. Without the addition of a gas there does not occur any lateral spreading-out or fanning of the steel, rather the steel only flows with a large velocity through the slotted region at the bottom of the pouring tube. In the event there is employed a bath level which, as is generally the case, is covered by slag, then due to the intentionally realized flow in the liquid metal pool the slag temperature and therefore also the lubrication conditions are more uniform, leading to further improvement in the surface quality of the cast strand.

During the casting of strands with rectangular cross-section, such as for instance slabs, the steel treated with the gas is advantageously introduced into the mold in the form of a pattern which is located in a substantially vertical plane extending substantially through the center of the narrow sides of the mold. During the casting of such strands at curved or arcshaped continuous casting installations where the mold possesses a curved mold cavity, or at casting installations where the strand shortly after departing from the mold is transferred into a curved path of travel, the pattern, considered in the direction of travel of the strand, is advantageously directed at an angle towards the inner radius of the curved mold.

The kinetic energy and thus the in-flow or penetration depth of the steel-gas mixture can be influenced and regulated by the selective addition of different quantities of gas. In this way it is possible, for instance, to make accommodation for different casting conditions, such as for example upon changing the casting speed.

Suitable as the infed gas is any inert gas, but advantageously there can be particularly employed argon, and it is preferable if the employed quantity of argon per ton of cast steel amounts to between 1 to 6 normal liters.

As explained above not only is the invention concerned with the aforementioned method aspects but also pertains to a new and improved construction of apparatus for the performance thereof, and wherein such apparatus comprises a pouring tube equipped with an outlet opening which opens downwardly and laterally and a gas infeed means above such outlet opening. The width of the coherent outlet opening advantageously should be in the order of between 6 and 30 millimeters.

During the continuous casting of slabs at curved or arc-shaped continuous casting installations or at installations in which the straight strand emanating from a vertical mold is deflected into an arc or curve, it can be advantageous to have the outlet opening inclined in the strand direction of travel towards the inner radius of the installation or the strand guide assembly, the inclination being at an angle which preferably amounts to about 4° to 6°. This can be realized by providing an inclined or oblique construction of the outlet slot with respect to the lengthwise axis of the pouring tube which is then essentially vertically mounted at the mold or by inclining the pouring tube itself.

If the infeed of metal from a tundish via the pouring tube into the mold is requlated by means of a stopper, then it is advantageous to undertake the infeed of the gas above the stopper. In this regard the gas infeed device can be constituted by a conduit or pipe which leads through the stopper rod and which opens into the stopper head. In this way there is achieved the result that there is realized a good admixing of the gas and steel already at the location of entry of the casting jet and thus there is optimumly utilized the effect of the gas for a given quantity thereof.

If the regulation occurs by means of a slide assembly then the infeed of the gas can be constituted by a conduit leading through the pouring tube and opening into its throughflow channel or passage. Also delivery of the gas above the slide assembly or arrangement is possible.

The throughflow channel of the pouring tube can possess an oval cross-sectional configuration. This can be of advantage, for instance, during the casting of very narrow strands.

In order to bring about an improved admixing or commingling of the steel and gas as well as to provide an intensified lateral departure of the steel, it is advantageous to construct the throughflow channel so that it extends below the laterally upwardly directed slot. It is particularly advantageous to construct the bore of the throughflow channel so as to extend over one-half of the height of the outlet slot.

During the casting of slabs with pouring tubes of oval throughflow cross-section, the pouring tube is introduced into the mold such that the lengthwise axis of the cross-section is located substantially parallel to the wide sides of the mold.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
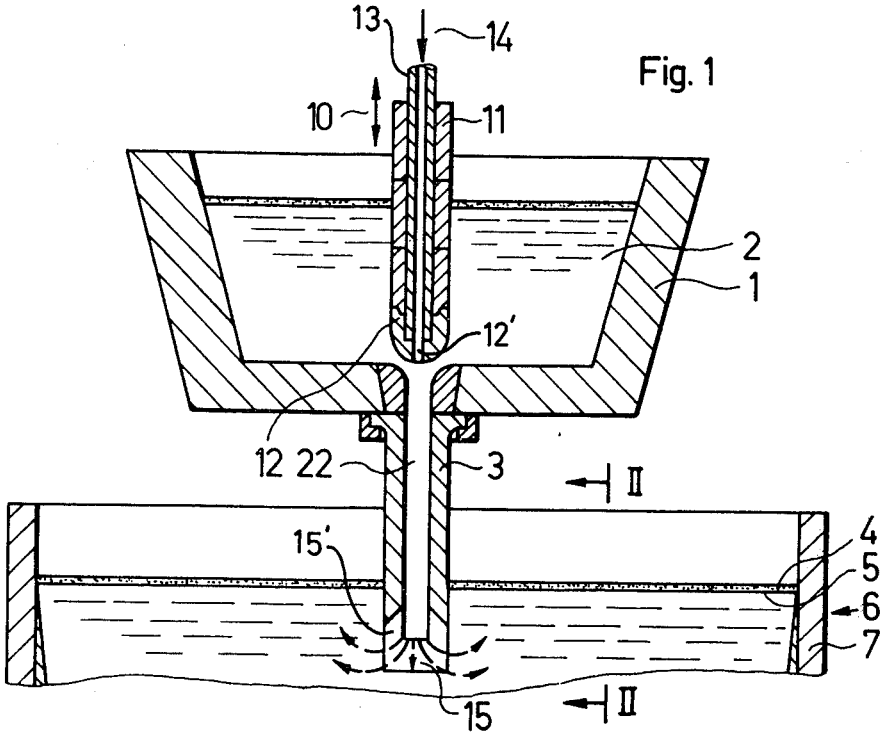
FIG. 1 is a cross-sectional view through a tundish equipped with a subsequently arranged pouring tube which immerses into the liquid metal pool or bath of the continuous casting mold and also illustrating a gas delivery or infeed device extending through a stopper.

Describing now the drawing, in FIG. 1 there is illustrated a casting or pouring vessel 1, here shown for instance in the form of a tundish from which the liquid metal, typically steel 2 is delivered into a continuous casting mold 6 through the agency of a pouring tube 3 to a point below the bath level 5 covered by a slag layer 4. The metal infeed, as indicated generally by the double-headed arrow 10, can be regulated by raising or lowering a stopper 11 as is conventional practice in the continuous casting art. The stopper 11 is internally provided with a conduit or line 13 serving as the gas infeed means, this conduit opening into the stopper head 12, as shown. An inert gas, argon for instance, is delivered through the conduit 13 in the direction of the arrow 14 as schematically illustrated. This gas arrives through the agency of the hollow stopper 11 constructed as a conduit at the location of the outlet 12' provided at the stopper head 12 where the steel is then admixed therewith while forming small gas bubbles. However, the stopper 11 also can be constituted by a monolithic refractory body having a central bore which can be employed for conducting therethrough the gas.

The immersible pouring tube 3 which is arranged after the tundish 1 possesses at a location following a substantially cylindrical bore which forms the throughflow channel 22, a continuous slot-like outlet opening 15 for the steel and the steel-gas mixture respectively. This outlet opening 15 is open both downwardly as well as laterally, and the steel-gas mixture is formed at the location where there is formed the casting jet. The steel-gas mixture is introduced into the casting head, i.e. the liquid metal pool in the form of a relatively thin, coherent fan or pattern both downwardly, i.e. in the direction of travel of the cast strand as well as also laterally. During the casting of strands with rectangular cross-section, for instance slabs, the fan or pattern of this steel-gas mixture is maintained in an approximately vertical plane which extends approximately through the center of the mold narrow sides 7, i.e. the pouring tube 3 is mounted with regard to the mold 6 in a position such that the lateral openings 15' of the outlet slot or opening 15 are directed towards the narrow sides 7 of the mold 6.

Figure 2:
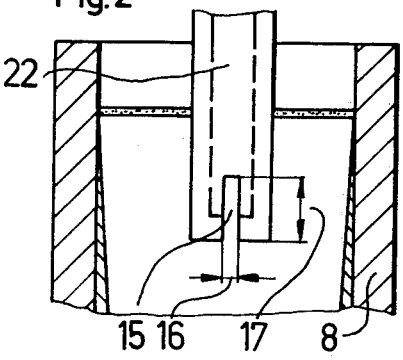
FIG. 2 is a cross-sectional view of the arrangement shown in FIG. 1, taken substantially along the line II—II thereof.

As best seen by referring to FIG. 2 the width 16 of the outlet opening 15 is considerably smaller than its height 17. It can be governed in conjunction with the height 17 as a function of the casting speed, i.e. the throughput quantity of steel, and advantageously should amount to between 6 and 30 millimeters.

Figure 3:
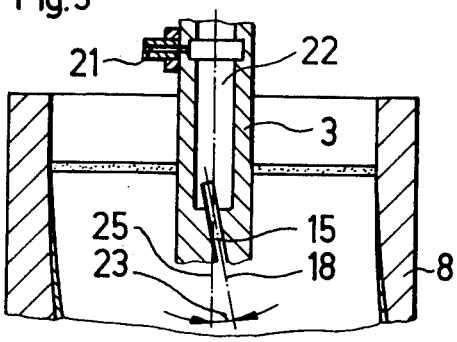
FIG. 3 is a further exemplary embodiment of the invention employing an inclined slot and a gas infeed or delivery means extending through the pouring tube.

According to a further exemplary embodiment of the invention as shown in FIG. 3 for the casting of rectangular strands in an arc-shaped or curved mold, the central plane 18 of the output opening 15 and the fan or pattern of the outflowing steel-gas mixture into the casting head are inclined with regard to a vertical plane 25 at an angle 23, and specifically, viewed in the direction of travel of the strand, towards the inner radius or inner curved portion of the curved mold. This angle can be adjusted by providing an inclined or oblique construction of the outlet slot or opening 15 in the pouring tube 3 itself or by inclining the pouring tube which then would have a straight slot. The angle 23 is advantageously maintained between 4° and 6°. The introduction of the steel in the form of a fan or pattern which is inclined with respect to the vertical also can be of advantage in the case of casting installations where the strand after departing from a mold having a vertical mold cavity is transferred into a curved configuration.

In this embodiment the infeed of gas occurs through the agency of a conduit 21 leading through the wall of the pouring tube 3 to the location of the throughflow channel 22 thereof.

As previously mentioned there can be used any inert gas, but advantageously there is used argon. With an increasing quantity of the used gas the flow formation in the direction of the narrow mold sides 7 is intensified and the vertical flow is decreased. Generally, it is satisfactory if there is added for each ton of cast steel a quantity of argon amounting to between 1 to 6 normal liters.

For the purpose of casting a slab with a cross-section of 1700 × 200 mm with a radius of 12 meters there is employed, for instance, a pouring tube having a bore of 55 millimeters and a lateral slot length i.e. height 17 of 125 millimeters. The width 16 of the outflow opening amounts to 20 millimeters. The central plane 18 of the outlet slot 15 together with the vertical plane 25 encloses an angle of 5°. When adding 5 normal liters argon per ton of case steel there is realized a relatively pronounced turbulence in the casting head or liquid metal pool up to a location which is about 1 meter below the bath level. Below this relatively markedly defined turbulence zone there does not occur any appreciable and preferred flow patterns. In particular there is prevented the downward flow along the narrow sides of the mold which is very disadvantageous with respect to the floating-in of non-metallic inclusions.

Figure 5:
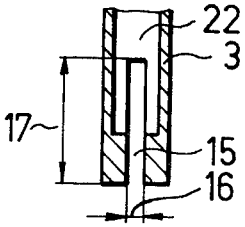
FIG. 5 is a cross-sectional view of the pouring tube depicted in FIG. 4, taken substantially along the line V—V thereof
Figure 4:
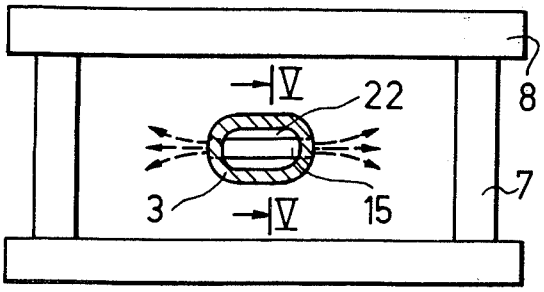
FIG. 4 illustrates a special construction of the pouring tube.

As best seen by referring to the variant construction of pouring tube as shown in FIGS. 4 and 5, the pouring tube 3 can also possess an approximately oval throughflow channel 22, wherein its lengthwise axis, during the casting of slabs, is located essentially parallel to the wide sides 8 of the mold. The oval throughflow channel 22, the width of which is greater than the width 16 of the outflow opening 15, viewed in the flow direction extends up to the region of the lower half of the slot height 17, as best seen by referring to FIG. 5.

With this solution there is realized a uniform turbulence zone in the casting head which extends to a region which is about 50 centimeters below the level of the bath. There does not occur any leading of the flow along both of the narrow sides of the mold.

While there is shown and described present preferred embodiments of the invention, it is to be distinctly understood that the invention is not limited thereto, but may be otherwise variously embodied and practiced within the scope of the following claims. ACCORDINGLY,

I claim:

1. A method of pouring molten metal, especially steel, into a continuous casting mold of a curved casting installation having an inner radius comprising the steps of conducting the steel by means of a pouring tube to a location beneath the level of the liquid metal pool in the mold, admixing with the steel at a time prior to its departure out of the pouring tube an inert gas while forming small gas bubbles, introducing the resultant steel-gas mixture into the mold in the form of a thin, coherent pattern of substantially constant width which is simultaneously directed both downwardly and laterally into the liquid metal pool in the mold and directing the pattern of the steel-gas mixture during its outflow into the liquid metal pool so as to be located in a plane which is inclined at an angle with respect to a vertical plane and which inclined pattern is directed towards the inner radius of the curved casting installation.

2. The method as defined in claim 1, further including the step of regulating the penetration depth of the steel-gas mixture into the liquid metal pool by admixing different quantities of gas.

3. The method as defined in claim 1, including the step of utilizing as the gas argon in an amount of 1 to 6 normal liters for each ton of cast steel.

4. An apparatus for pouring steel into a continuous casting mold of a curved casting installation having an inner radius, comprising a pouring tube having an outlet opening capable of opening into the liquid metal pool of the mold, said outlet opening possessing a substantially slot-shaped configuration of substantially constant width which opens downwardly and laterally, a central plane of said outlet opening viewed in the direction of travel of the cast strand being inclined at a predetermined angle with respect to the inner radius of the curved casting installation, and gas infeed means provided above said outlet opening.

5. The apparatus as defined in claim 4, wherein the width of said outlet opening is in the order of between 6 and 30 millimeters.

6. The apparatus as defined in claim 4, wherein said predetermined angle is in the order of between about 4° and 6°.

7. The apparatus as defined in claim 4, further including a stopper-regulated casting vessel operatively associated with the pouring tube, said casting vessel being equipped with a stopper having a stopper head, said gas infeed means comprising a conduit leading through said stopper and opening at the region of the stopper head.

8. The apparatus as defined in claim 4, wherein said pouring tube possesses a throughflow channel, said gas infeed means comprising a conduit extending through the pouring tube and opening into said throughflow channel.

9. The apparatus as defined in claim 4, wherein said pouring tube has a throughflow channel possessing a substantially oval cross-sectional configuration.

10. The apparatus as defined in claim 4, wherein the outlet opening has an upper end, said pouring tube has a throughflow channel which extends to a location which is below the upper end of the outlet opening.

11. The apparatus as defined in claim 16, wherein said throughflow channel extends to a point beneath one-half of the height of the outlet opening.

12. The apparatus as designed in claim 10, wherein said throughflow channel has a portion extending to a point which is located at the lower half of the height of the outlet opening.

* * * * *